United States Patent [19]

Ford

[11] Patent Number: 5,075,523

[45] Date of Patent: Dec. 24, 1991

[54] SIGNAL ACTIVATING DEVICE FOR A NURSE CALL SYSTEM

[76] Inventor: Ralph W. Ford, 8061 SE. Eaglewood Way, Hobe Sound, Fla. 33455

[21] Appl. No.: 577,327

[22] Filed: Sep. 4, 1990

[51] Int. Cl.[5] ..... H01H 13/16

[52] U.S. Cl. ..... 200/330; 200/85 R; 200/331; 200/17 R; 200/317; 200/333; 200/338; 200/DIG. 2; 200/DIG. 35

[58] Field of Search ..... 200/330, 331, 333, 338, 200/341, DIG. 6, DIG. 35, 518, 17, 294, 296, 310, 317, 85 R, DIG. 2

[56] References Cited

U.S. PATENT DOCUMENTS

| | | | |
|---|---|---|---|
| 4,067,005 | 1/1978 | Levy et al. | 200/85 R X |
| 4,086,458 | 4/1978 | Dickey | 200/85 R |
| 4,172,216 | 10/1979 | O'Shea | 200/85 R |
| 4,293,752 | 10/1981 | Koenig | 200/295 |

*Primary Examiner*—Ernest G. Cusick
*Attorney, Agent, or Firm*—Malloy, Downey & Malloy

[57] ABSTRACT

A signal activating device for activating a nurse call system as commonly used in hospitals and nursing homes to summon the attending personnel for assistance, wherein an elongate bar having circuitry electrically interconnected to the call system is supported on the railing structure of a bed or chair so as to extend transversely thereacross in a readily accessible location over a midportion of the body of a person in the bed or chair. A hollow tube is fitted over the bar in engaging, supported relation on a number of electric switches mounted at spaced intervals along the bar's length such that pressure applied by the person to any location along the upper portion of the tube serves to operate at least one electric switch on the bar, thereby activating the nurse call system.

12 Claims, 1 Drawing Sheet

SIGNAL ACTIVATING DEVICE FOR A NURSE CALL SYSTEM

FIELD OF THE INVENTION

Most hospitals and nursing homes have a nurse call system to allow a patient or any bedridden person who is generally immobilized to summon a nurse or other attending personnel for assistance. This is ordinarily accomplished by pulling a string which is routed to the patient's bed from a wall switch usually four to six feet from the bed. By pulling the string, the wall switch is tripped which in turn activates the nurse call system. Usually the nurse call system includes flashing lights, including a flashing light outside the patient's room and a second flashing light at a master panel at the nurses' station. Additionally, there is usually a pulsating buzzer or other noise producing mechanism at the nurses' station. Also, a small red LED, or other like indicating means, is mounted on the wall switch plate and illuminates to indicate to the patient that the switch has been successfully tripped and the call system has been activated.

While this nurse call system has been found to be somewhat effective and generally functions satisfactorily for patients who have full use of their arms, hands and vision, there are numerous problems associated with the string activating mechanism, as well as other types of nurse call activating mechanisms, which have been found to be difficult, if not impossible to operate by a handicapped patient. A common problem found with using the string activating mechanism is that the string often gets mixed in with and/or hidden by the bed linens and blankets to the point where it is even difficult for a person with all of their faculties to locate and pull the string in such a manner as to effectively trip the wall switch. Another problem with the string mechanism is that it often falls to the floor where it is impossible to reach without getting out of bed, which is an impossible task for many handicapped, bedridden patients. Even if the string is positioned properly, with no obstructions, it is extremely difficult to find the string in the dark. Obviously, blind patients always experience a great deal of difficulty locating this elusive nurse call activating mechanism. Additionally, the physical nature of the string activating mechanism makes it not suitable for use by most patients. Because many patients are confined to their bed and have limited control over their coordination and muscle control, they do not have the ability to securely hold a piece of extension string, fully extend their arm and then find the strength to trip the wall switch and activate the nurse call system. It should be therefore apparent that many patients exposed to the existing nurse call systems do not have sufficient access to quick and efficient communication in the event of a life threatening emergency or even during the ordinary course of taking care of routine physical needs such as elimination of wastes, taking of medication, replenishing liquids and other such needs.

Accordingly, there exists an urgent need in the field of patient care for a signal activating device for use with a nurse call system which is readily accessible to the user patient and requires little effort to operate. It is therefore an object of the present invention to provide a signal activating device for activating a nurse call system which is adapted to be supportably positioned on the railing structure of a patient's bed or chair so as to extend transversely across the bed or chair slightly above the midsection of the patient's body in a readily accessible position. It is a further object of the present invention to provide a nurse call signal activating device which will require minimal effort to activate by requiring only a slight amount of pressure to be applied to any point along the length of a switch operating tube traversing the entire width of the bed, chair or other similar structure.

SUMMARY OF THE INVENTION

The present invention is directed to a signal activating device for activating a nurse call system as commonly used in many hospitals and nursing homes. The signal activating device is specifically designed to be supportably positioned across the railing structure of a patient's bed or a chair so as to be oriented in a readily accessible, easy to locate position. The activating device includes an elongate bar having a length generally equal to or slightly less than the width of the bed or chair on which it is to be positioned. A plurality of electric switches are mounted in spaced relation along a top portion of the bar substantially along its length. Each of the switches is electrically interconnected in parallel to a pair of conductors extending from a lead conductor cable at one end of the bar. The led conductor cable extends from the bar and preferably has a jack attached to its free distal end for plugging into a standard outlet as commonly found in most nurse call systems. It should be realized, however, that other means of interconnection can be used to effectively interconnect the circuitry of the signal activating device to the nurse call system.

Each of the electric switches includes a depressible button which is structured to move between an extended position and a depressed position. Moving the button to the depressed position on any of the switches serves to close the circuit between the pair of conductors extending through the elongate bar, thereby effectively directing current flow to the nurse call system for activation of various signals including flashing lights and sound actuation devices.

Additional switches may be mounted along the elongate bar and electrically interconnected to a signal device mounted on the bar such as a light source. Accordingly, upon depression of the depressible button, an indicating light on the bar would illuminate to indicate to the user that the nurse call system has been activated. Alternatively, an indicating light may be mounted in a readily visible location in the user patient's room in electrical connection with the nurse call system, the indicating light being structured to illuminate upon activation of the system.

An important feature of the present invention is an elongate hollow tube adapted to be fitted over a substantial length of the bar with an inner surface of the hollow tube in supported engagement with the depressible buttons of the electric switches. The hollow tube is specifically designed to facilitate ease of operation of the electric switches by requiring a minimal amount of pressure to be applied anywhere along an upper portion of the tube in order to effectively move at least one of the switch buttons to the depressed operable position, thereby activating the nurse call system.

The signal activating device of the present invention is supportably positioned on the railing structure of the patient's bed or chair by a pair of hook shaped brackets fitted at opposite ends of the bar and being specifically structured and configured to supportably fit over any standard railing structure. The hook shaped brackets are preferably secured to the railing by means of Velcro® so as to maintain the activating device in a supported, fixed position. Alternatively, one end of the bar may be permanently affixed to a railing which is normally maintained in its fixed upright position. This fixed attachment would preferably include a swivel means or hinge means so that with the opposite end of the bar having the hook shaped bracket, that end of the bar can be effectively lifted from its supported position and swung out of the way when necessary to allow ingress or egress in and out of bed as well as allowing for routine care of the patient.

The invention accordingly comprises the features of construction, combination of elements and arrangement of parts which will be exemplified in the description hereinafter set forth and the scope of the invention will be indicated in the claims.

BRIEF DESCRIPTION OF THE DRAWINGS

For a fuller understanding of the nature of the present invention, reference should be had to the following detailed description taken in connection with the accompanying drawings in which.

Like reference numerals refer to like parts throughout the several views of the drawings.

DETAILED DESCRIPTION OF THE PREFERRED EMBODIMENT

Figure 2:
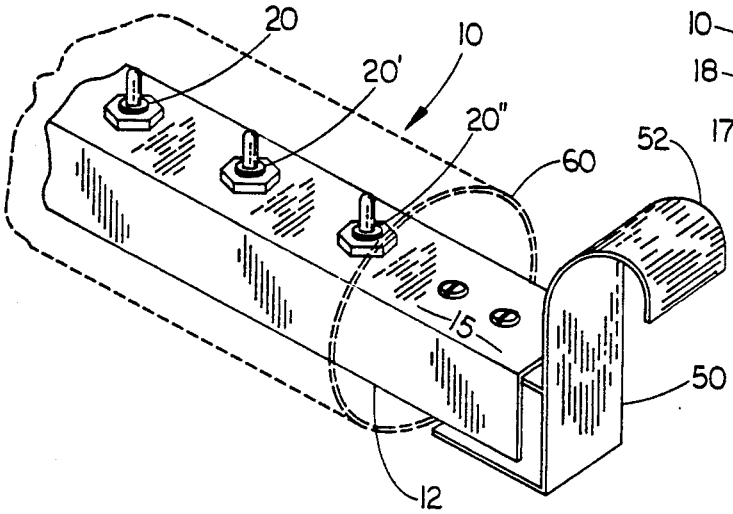
FIG. 2 is a perspective view in partial cutaway illustrating the various structural components of the signal activating device of the present invention.
Figure 3:
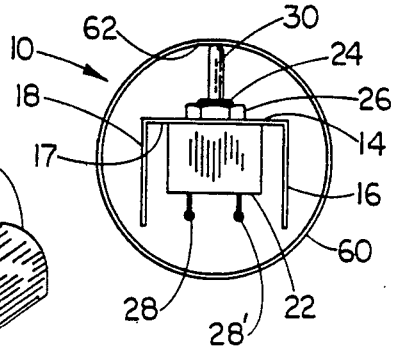
FIG. 3 is a partial sectional view taken along line 3–3 of FIG. 2.
Figure 4:
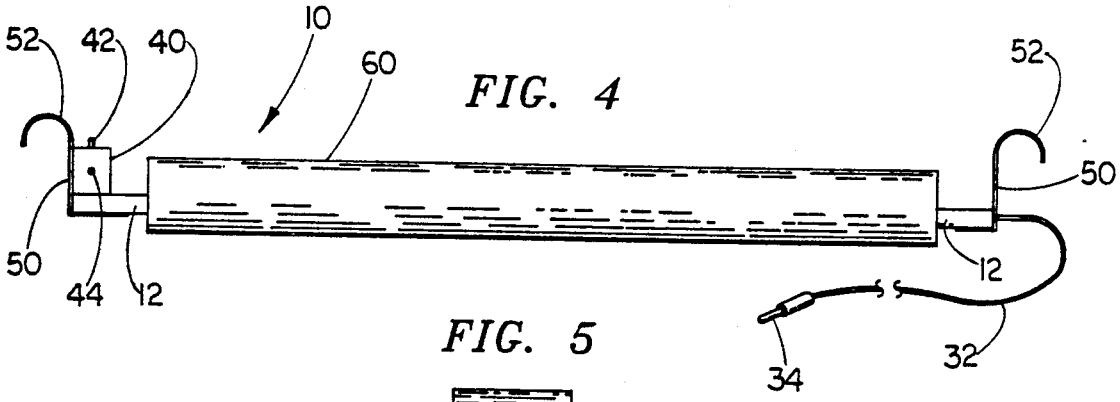
FIG. 4 is a side plan view of the signal activating device of the present invention.
Figure 5:
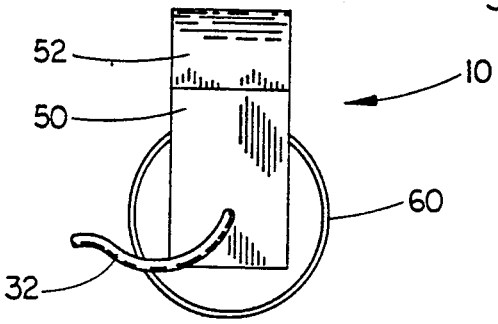
FIG. 5 is an end plan view of the signal activating device of the present invention.

As best illustrated in FIGS. 2 through 4, the present invention is directed to a signal activating device 10 specifically designed for use in activating a nurse call system as commonly used in many hospitals and nursing homes. The signal activating device 10 includes an elongated bar 12 having a substantially U-shaped configuration including a top base portion 14 and two downwardly extending side portions 16 and 18, as best shown in FIG. 3. The top base portion 14 includes a top surface 15 and an underside surface 17.

A plurality of electric switches, including switches 20, 20' and 20'' are mounted in spaced relation along a substantial portion of the length of the top base portion 14 of the elongate bar 12. Each of the electric switches includes a switch housing 22 having a standard electric switch mechanism therein. The switch housing 22 is preferably mounted to the underside surface 17 of the top base portion 14 of the bar 12. The switch housing 22 is secured in place by a threaded collar 24 which extends up through the top base portion 14 where a conventional threaded nut 26 fitted thereon is tightened down on the top surface 15 so as to secure the switch housing 22 in fixed position on the underside surface 17. Each of the electric switches, such as 20, 20' and 20'' is electrically interconnected to a pair of parallel conductors 28 and 28' extending substantially through the length of the elongate bar 12 and attaching to a lead conductor cable 32 extending from one end of the bar 12.

A jack 34 is attached to a free distal end of the lead conductor cable 32 and is adapted to be plugged into a standard outlet for interconnection with the nurse call system.

Figure 1:
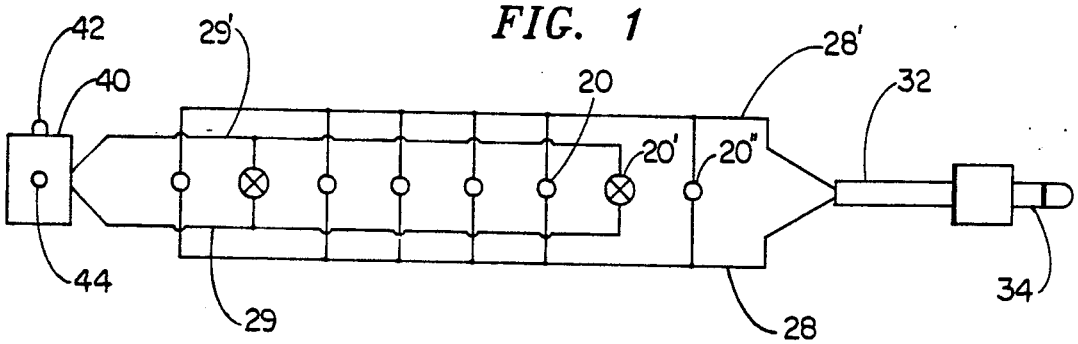
FIG. 1 is a schematic view illustrating the electrical interconnection of the circuitry of the signal activating device of the present invention.

As shown in the schematic of FIG. 1, some of the electric switches including switches 20 and 20'' are electrically connected in parallel to the conductors 28 and 28' so that operation of at least one of the switches serves to cause a closed circuit condition, thereby completing the flow of current through the circuitry of the activating device and to the nurse call system for activation thereof. Additionally, some of the electric switches, including switch 20' may be electrically interconnected in parallel to a second pair of conductors 29 and 29' extending from a light source 40. Accordingly, depression of the switch 20' serves to complete current flow to the light source 40 thereby illuminating an indicating light 42 to indicate to the user that the switches have been effectively depressed and the nurse call system effectively activated. A reset button 44 on the light source allows the user to reset the indicating light 42 after each use.

In order to secure the elongate bar 12 in supported position across a patient's bed or chair, a pair of securing brackets 50 are mounted on opposite ends of the elongate bar 12 and include a hook shaped portion 52 being generally configured so as to supportably rest over any standard railing structure. In this manner, each of the brackets 50 can be supportably placed over a railing on opposite sides of the patient's bed so that the elongate bar extends transversely across the bed slightly above a midsection of the patient's body.

An important feature of the present invention is an elongate hollow tube 60 fitted over the elongate bar 12, with an inner surface 62 of the tube 60 resting in engaging, supported position on the depressible buttons 30 of each of the electric switches including switches 20, 20' and 20''. In this manner, the patient can effectively depress at least one, but usually several of the buttons 30 for activation of the nurse call system by simply applying pressure with a hand, arm or any other available means to an upper surface of the tube 60. A minimal force applied anywhere along the length of the upper surface of the tube 60 will effectively depress at least one of the buttons 30 thereby operating the corresponding electric switch for activation of the nurse call system.

While the present invention has been disclosed in connection with the preferred embodiment thereof, it should be understood that there may be other embodiments which fall within the spirit and scope of the invention as defined by the following claims.

What is claimed is:

1. For use in activating a nurse call system as commonly found in hospitals and nursing homes, a signal activating device comprising:

an elongate bar having a generally U-shaped configuration including a base portion and a pair of oppositely disposed downwardly extending sides, said base portion including a top surface and an underside surface extending between two opposite ends thereof, securing means attached to said opposite ends for securing said bar to two spaced apart supporting surfaces so as to extend transversely therebetween, switch means mounted on said bar, said switch means being operable between a normally open circuit position and a closed circuit position, a lead conductor cable electrically interconnected to said switch means and extending from said bar, switch operating means including a hollow tube fitted about an exterior of said bar extending substantially along a length thereof, and including an inner surface disposed in contact with said switch means, said hollow tube being structured and disposed to facilitate operation of said switch means between said open circuit position and said closed circuit position upon applying pressure thereto, and whereby said closed circuit condition causes a current flow to be directed to the nurse call system for activation thereof.

2. The device as in claim 1 wherein said switch means includes a plurality of electric switches mounted in spaced relation along a length of said base portion of said bar.

3. The device as in claim 2 wherein said plurality of electric switches each include a depressible button adapted to be operated by depressing between a raised position defining said open circuit position and a depressed position defining said closed circuit position.

4. The device as in claim 3 wherein each of said plurality of electric switches further include a switch housing mounted to said underside surface of said bar with said depressible button extending therefrom and through said base portion so as to extend upwardly from said top surface of said bar.

5. The device as in claim 4 wherein each of said plurality of electric switches are electrically connected in parallel to a pair of conductors extending from said lead conductor cable so that operation of one or more of said electric switches by depressing to said closed circuit position serves to direct said current flow to the nurse call system for activation thereof.

6. The device as in claim 5 wherein said switch operating means comprises an elongate hollow tube fitted about an exterior of said bar substantially along the length thereof, with said depressible button of each of said plurality of electric switches supportably engaging an inner surface of said hollow tube such that pressure applied to an outer exterior surface of said tube causes said depressible button of at least one of said electric switches to be depressed to said closed circuit position thereby activating the nurse call system.

7. The device as in claim 6 wherein a jack is attached to a free distal end of said lead conductor cable to facilitate electrical interconnection with an electrical outlet of the nurse call system.

8. The device as in claim 7 wherein said securing means comprises a pair of substantially hook shaped brackets including a first hook bracket and a second hook bracket each one being attached to one of said opposite ends of said bar and being structured and configured for supporting engagement with a railing structure of a bed so as to support said bar transversely across the bed in a readily accessible position and orientation.

9. The device as in claim 8 further comprising light indicating means mounted to said bar to indicate activation of the nurse call system.

10. The device as in claim 9 wherein said light indicating means includes a light source mounted on said bar.

11. The device as in claim 10 wherein at least one of said electric switches is electrically interconnected to said light source so that movement of the depressible button of said electric switch to a depressed position causes the flow of current to be directed to said light source for illumination thereof.

12. For use in activating a nurse call system as commonly found in hospitals and nursing homes, a signal activating device comprising:

an elongate bar having a top surface and an underside surface extending between two opposite sides, securing means attached to said opposite ends for securing said bar to two spaced apart supporting surfaces so as to extend transversely therebetween, a plurality of switches mounted in spaced relation along a length of said bar, each of said plurality of switches being electrically interconnected with a pair of conductors and being operable between a normally open circuit position and a closed circuit position wherein operation of at least one of said switches serves to complete an electric circuit between the pair of conductors, a jack attached to free distal ends of said pair of conductors, a hollow tube fitted about an exterior of said bar extending substantially along the length thereof and including an inner surface disposed in contact with said plurality of switches, said hollow tube being structured and disposed to facilitate operation of at least one of said switches between said open circuit position and said closed circuit position upon applying pressure thereto, and whereby operation of at least one of said switches to said closed circuit position serves to activate the nurse call system.

* * * * *